US005737964A

United States Patent [19]

Shiga et al.

[11] Patent Number: 5,737,964

[45] Date of Patent: Apr. 14, 1998

[54] STARTER WITH PLANETARY GEAR SPEED REDUCTION MECHANISM

[75] Inventors: Tsutomu Shiga, Nukata-gun; Nobuyuki Hayashi, Nagoya; Masanori Ohmi, Anjo; Sadayoshi Kajino, Nagoya, all of Japan

[73] Assignee: Nippondenso Co., Ltd., Kariya, Japan

[21] Appl. No.: 681,463

[22] Filed: Jul. 23, 1996

Related U.S. Application Data

[63] Continuation of PCT/JP95/02409 Nov. 24, 1995 which is a continuation-in-part of PCT/JP94/01987 Nov. 24, 1994.

[51] Int. Cl.[6] ..... F02N 11/00; F02N 15/06

[52] U.S. Cl. ..... 74/7 E; 290/38 R; 310/238; 310/239; 310/242

[58] Field of Search ..... 74/7 E; 290/38 R, 290/38 C, 48; 310/238, 239, 242

[56] References Cited

U.S. PATENT DOCUMENTS

| | | | |
|---|---|---|---|
| 3,497,706 | 2/1970 | Burkett | 290/31 |
| 4,816,712 | 3/1989 | Tanaka | 310/237 |
| 5,258,651 | 11/1993 | Sherman | 290/23 |

FOREIGN PATENT DOCUMENTS

| | | |
|---|---|---|
| 60-175763 | 9/1985 | Japan . |
| 62-35119 | 2/1987 | Japan . |
| 63-31263 | 2/1988 | Japan . |
| 5-141332 | 6/1993 | Japan . |

*Primary Examiner*—Allan D. Herrmann
*Attorney, Agent, or Firm*—Cushman Darby & Cushman IP Group of Pillsbury Madison & Sutro LLP

[57] ABSTRACT

Around the outer circumference of an armature core 520, there are arranged a stator core 558 and a stator coil 559 wound on the stator core 558, forming a fixed magnetic field device. The stator coil 559 has its one end portion arranged in the space at the outer circumference of a planetary gear speed reduction mechanism 300, i.e., at the outer circumference of a center bracket 360. A motor partition 800 is formed with a stepped portion 810 so as to accommodate the aforementioned one end portion. On the other hand, the other end of the stator coil 559 is arranged in the space at the outer circumference of a brush 910. In short, the planetary gear speed reduction mechanism 300 has its external diameter made smaller than the inner circumferential diameter of the stator coil 559.

6 Claims, 12 Drawing Sheets

STARTER WITH PLANETARY GEAR SPEED REDUCTION MECHANISM

This is a continuation of International Application. No. PCT/JP95/02409, filed Nov. 24, 1995, which designated the U.S. and which was a continuation in part of International Application No. PCT/JP94/01987, filed Nov. 24, 1994.

TECHNICAL FIELD

The present invention relates to a starter with a planetary gear speed reduction mechanism for starting an engine.

BACKGROUND ART

In the starter with the planetary gear speed reduction mechanism of the prior art, there is disclosed in Japanese Patent Laid-Open No. 110931/1988 a face type commutator for a starter motor, which is formed generally perpendicularly to the axial direction of an armature shaft.

However, since the prior art construction has an axially or serially aligned structure of the planetary gear speed reduction mechanism, a magnetic field device of the starter motor, a brush device and a magnet switch on a common axis, the axial length is further increased if the starter motor is enlarged to improve the output, so that the starter has its engine mountability seriously deteriorated. At the time of mounting the starter on the engine, still the worse, the length from mounting face to the motor and the magnet switch is increased to deteriorate the impact-resistance.

The present invention has been conceived in view of the background described above and has a first object to provide a starter with a planetary gear speed reduction mechanism, which has its axial length suppressed and its mountability and impact-resistance improved.

DISCLOSURE OF THE INVENTION

In order to achieve the above-specified object, according to the present invention, there is provided a starter with a planetary gear speed reduction mechanism, comprising: a starter motor including an armature shaft for rotatably holding an armature core wound with an armature coil, a commutator connected with the armature coil and arranged generally in parallel with the end portion of the armature core, a brush slidably held by the commutator, and a magnetic field device arranged on the outer circumference of the armature core; and a planetary gear speed reduction mechanism including a sun gear formed on the outer circumference of the armature shaft of the startor motor, a drive shaft arranged coaxially with the armature shaft, a planetary gear borne on one end of the drive shaft and meshing with the sun gear, and an internal gear meshing with the planetary gear; wherein the field device of the starter motor has its end portion overlapping at least one of the planetary gear speed reduction mechanism and the brush.

According to this construction, the field device of the starter motor has its end portion overlapping at least one of the outer circumference of the planetary gear speed reduction mechanism and the outer circumference of the brush so that the axial length of the field device required in the prior art can be absorbed by the space at the outer circumference of the planetary gear speed reduction mechanism and the outer circumference of the brush to reduce the axial length. As a result, the starter can have its mountability and impact-resistance improved.

In addition, the armature coil has its end portion arranged generally in parallel with the end face of the armature core and electrically connected to another coil end portion connected to another armature coil arm spaced away by a predetermined pitch, so that the coil end portion is formed as a commutator.

According to this construction, the armature coil has its end portion which does not require a conventional coil end portion twisted for connection of coil piece and commutator piece nor a face type commutator as a separate component part. As a result, the axial length of the armature itself can be remarkably reduced without requiring the commutator of the prior art, and the field device can have its end portion arranged in the space of the outer circumference of the brush so that the axial length of the starter can be totally reduced.

In addition, there is further comprised a magnet switch for supplying an electric power to the starter motor, the magnet switch being arranged at the brush side of the starter motor and generally perpendicularly to the axial direction of the armature shaft.

According to this construction, a space required for a plunger operation need not be provided in the axial direction of the armature shaft, and only an outer diametrical length of the magnet switch adds in the axial direction. Thus, the axial length to the end portion of the magnet switch can be further reduced.

Further, a motor partition wall is made of a magnetic material and is arranged adjacent to an end face of a fixed magnetic filed device, so that a leakage magnetic flux caused around the axial end portion of the field device is collected and the magnetic flux is restricted from staying around the coil end portion. Thus, undesired influence on the commutation can be reduced.

BEST MODE FOR CARRYING OUT THE INVENTION

Figure 1:
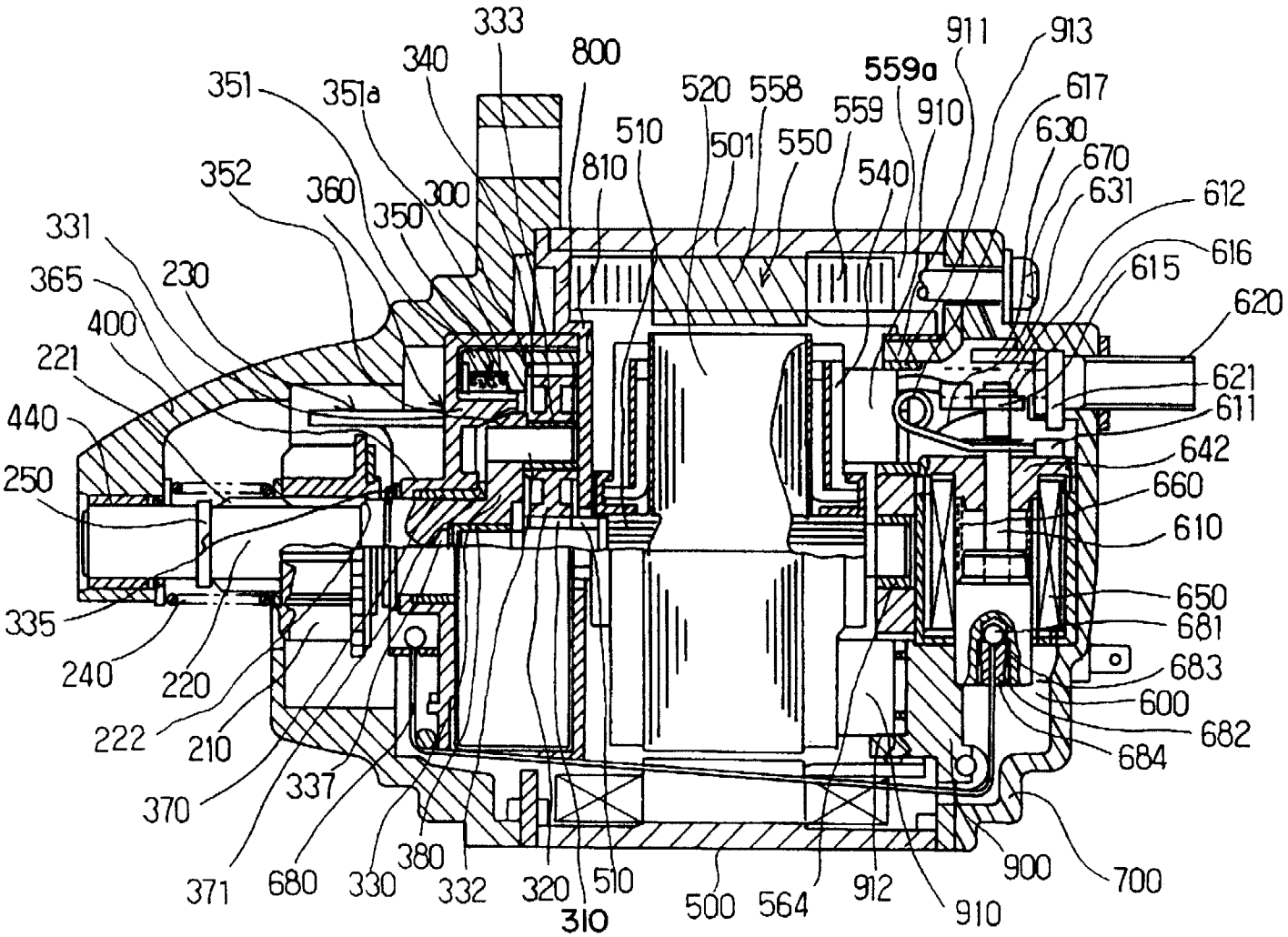
FIG. 1 is a sectional side elevation showing an embodiment of a starter of the present invention.

Next, a starter of the present invention will be described in connection with its one embodiment with reference to FIGS. 1 to 17.

The starter is generally divided into: a housing 400 enclosing a pinion 200 meshing with a ring gear 100 arranged at an engine and a planetary gear mechanism 300; a motor 500; and an end frame 700 enclosing a magnet switch 600. In the starter, moreover, the housing 400 and the motor 500 are partitioned by a motor partition 800, and the motor 500 and the end frame 700 are partitioned by a brush holding member 900.

[Pinion 200]

Figure 2A:
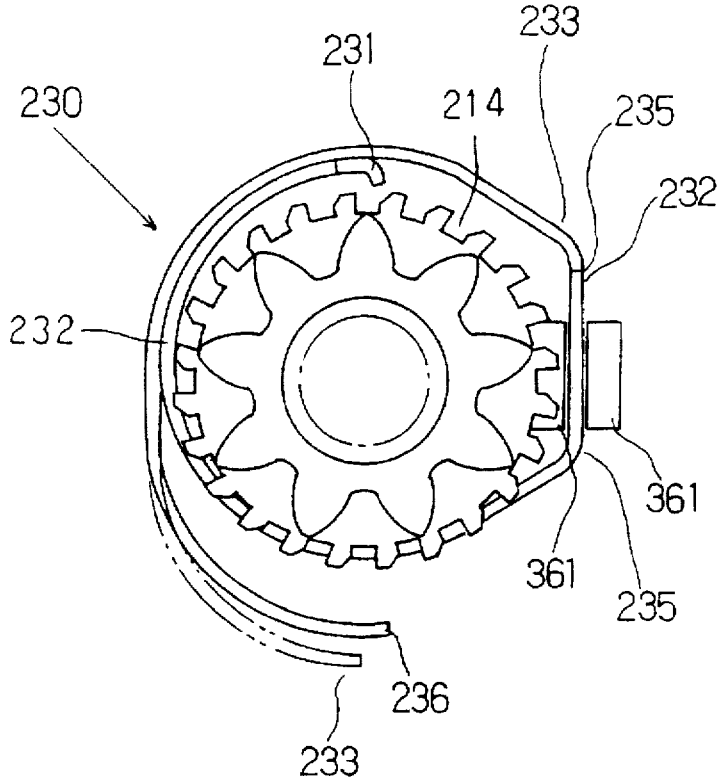
FIGS. 2A and 2B are a front elevation and a partially sectional side elevation when a pinion rotation regulating member is assembled with a pinion portion.
Figure 2B:
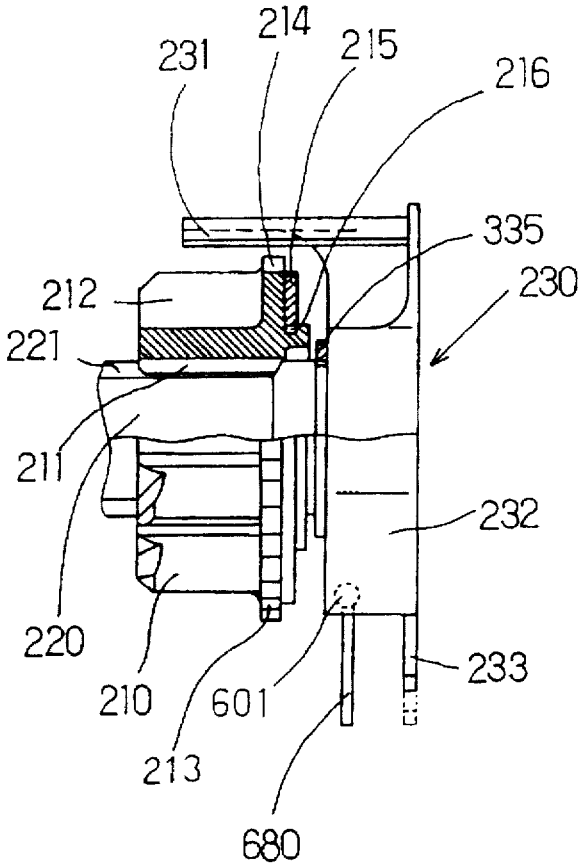

As shown in FIG. 1, 2A or 2B, the pinion 200 is formed with a pinion gear 210 meshing with the ring gear 100 of the engine.

The pinion gear 210 is formed in its circumference with a pinion helical spline 211 to be fitted in a helical spline 221 formed in an output shaft 220. The pinion gear 210 is formed, at the side opposed to the ring gear, with an annular flange 213 having a larger diameter than the external diameter of the pinion gear 210. This flange 213 is formed all over its outer circumference with teeth 214 having a larger number than that of the external teeth of the pinion gear 210. These teeth 214 are provided for fitting a regulating pawl 231 of a later-described pinion rotation regulating member 230. A washer 215 is made rotatable at the rear face of the flange 213 but prevented from axially coming out by bending an annular portion 216, which is formed at the rear end of the pinion gear 210, toward the outer circumference.

On the other hand, the pinion gear 210 is always urged backwards of the output shaft 220 by a return spring 240 made of a compression coil spring.

[Pinion Rotation Regulating Member 230]

Here will be described the operations of the pinion rotation regulating member 230. A string member 680 is transmission means for transmitting the operation of the magnet switch 600 to the regulating pawl 231. The string member 680 is caused by the operation of the magnet switch 600 to pull the rotation regulating portion 232 downwards thereby to establish the engagement between the regulating pawl 231 and the teeth 214 of the flange 213 of the pinion gear 210. Since the regulating pawl 231 engages with the teeth 214 of the pinion gear 210, the pinion gear 210 is moved forwards, when turned through an armature shaft 510 of the motor 500 and the planetary reduction mechanism 300, along the helical spline 221 of the output shaft 220. When the pinion gear 210 comes into abutment against the ring gear 100 so that its forward movement is blocked, the pinion rotation regulating member 230 itself is bent by the further rotating force of the output shaft 210 so that the pinion gear 210 is slightly rotated to mesh with the ring gear 100. As the pinion gear 210 moves forwards, the regulating pawl 231 goes out of engagement with the teeth 214 so that the regulating pawl 231 drops at the back of the flange 213 of the pinion gear 210 to have its front end abutting against the rear face of the washer 215 thereby to prevent the pinion gear 210 from being retracted by the rotation of the ring gear 100 of the engine.

[Planetary Gear Mechanism 300]

The planetary gear mechanism 300 is reduction means for reducing the rotational speed of the later-described motor 500 to augment the output torque of the motor 500, as shown in FIG. 1. This planetary gear mechanism 300 is composed of: a sun gear 310 formed on the outer circumference of the front side of the armature shaft 510 (as will be described later) of the motor 500; three pairs of planetary gears 320 made rotatable around the sun gear 310; a planet carrier 330 made integral with the output shaft 220 for supporting the planetary gears 320 rotatably around the sun gear 310; and an internal gear 340 made of a resin into a cylindrical shape meshing with the outer circumferences of the planetary gears 320.

[Overrunning Clutch 350]

The overrunning clutch 350 is so supported as to rotate the internal gear 340 only in one direction (to rotate in response to the revolution of the engine). This overrunning clutch 350 is composed of a clutch outer 351 made integral with the front side of the internal gear 340 to form a first cylindrical portion, an annular clutch inner 352 formed at the rear face of a center bracket 360 to form the stationary side covering the front of the planetary gear mechanism 300 and a second cylindrical portion arranged to confront the inner circumference of the clutch outer 351, and rollers (not shown) fitted in a roller path 351*a* formed at an inclination in the inner circumference of the clutch outer 351.

[Center Bracket 360]

The center bracket 360 is arranged in the rear side of the housing 400. The housing 400 and the center bracket 360 are connected by a ring spring (not shown), which has its one end retained by the housing 400 and its other end retained by the center bracket 360, so that the rotational reaction to be received by the clutch inner 352 forming part of the overrunning clutch 350 may be absorbed by the ring spring and prevented from being transmitted directly to the housing 400.

[Planet Carrier 330]

The planet carrier 330 is equipped at its rear end with a flanged projection 331 radially extending for supporting the planetary gear 320. In this flanged projection 331, there is fixed a pin 332 extending backwards for supporting the planetary gear 320 rotatably through a metal bearing 333. Moreover, the planet carrier 330 is rotatably supported by a housing bearing 440 having its front end portion fixed in the front end of the housing 400, and a center bracket bearing 370 fixed in an inner cylindrical portion 365 of the inner circumference of the center bracket 360.

This planet carrier 330 is formed at its front end with an annular groove, in which is fitted a stop ring 335. Between this stop ring 335 and the front end of the inner cylindrical portion 365, there is interposed a washer which is made rotatable with respect to the planet carrier 330. When the stop ring 335 comes into abutment against the front end of the inner cylindrical portion 365 through the washer, the planet carrier 330 is regulated from moving backwards. Moreover, the center bracket bearing 370 supporting the rear side of the planet carrier 330 is formed at its rear end with a flanged portion 371 which is interposed between the rear end of the inner cylindrical portion 365 and the flanged projection 331. When this flanged projection 331 comes into abutment against the rear end of the inner cylindrical portion 365, the planet carrier 330 is regulated from moving forwards.

Incidentally, an axially extending recess 337 is formed in a rear face of the output shaft 220. A shaft 510 has its front end rotatably supported through a planet carrier bearing 380 which is arranged in that recess 337.

[Motor 500]

The motor 500 is enclosed by the yoke 501, the motor partition 800 and the later-described brush holding member 900. Incidentally, the motor partition 800 accommodates the planetary gear mechanism 300 together with the center bracket 360 and acts to prevent the lubricating oil in the planetary gear mechanism 300 from invading the motor 500.

The motor 500 is constructed of, as shown in FIG. 1: the armature 540 composed of the armature shaft 510, and the armature core 520 and an armature coil 530 fixed on the armature shaft 510 and made rotatable together; and fixed magnetic field device 550 for rotating the armature 540. The fixed magnetic field device 550 is fixed on the inner circumference of the yoke 501.

[Armature Shaft 510]

The armature shaft 510 is rotatably borne by the planet carrier bearing 380 in the rear portion of the planet carrier 330 and a brush holding member bearing 564 fixed in the inner circumference of the brush holding member 900. The armature shaft 510 has its front end inserted in the planetary gear mechanism 300 and formed on its outer circumference with the sun gear 310 of the planetary gear mechanism 300.

[Armature Core 520]

Figure 4:
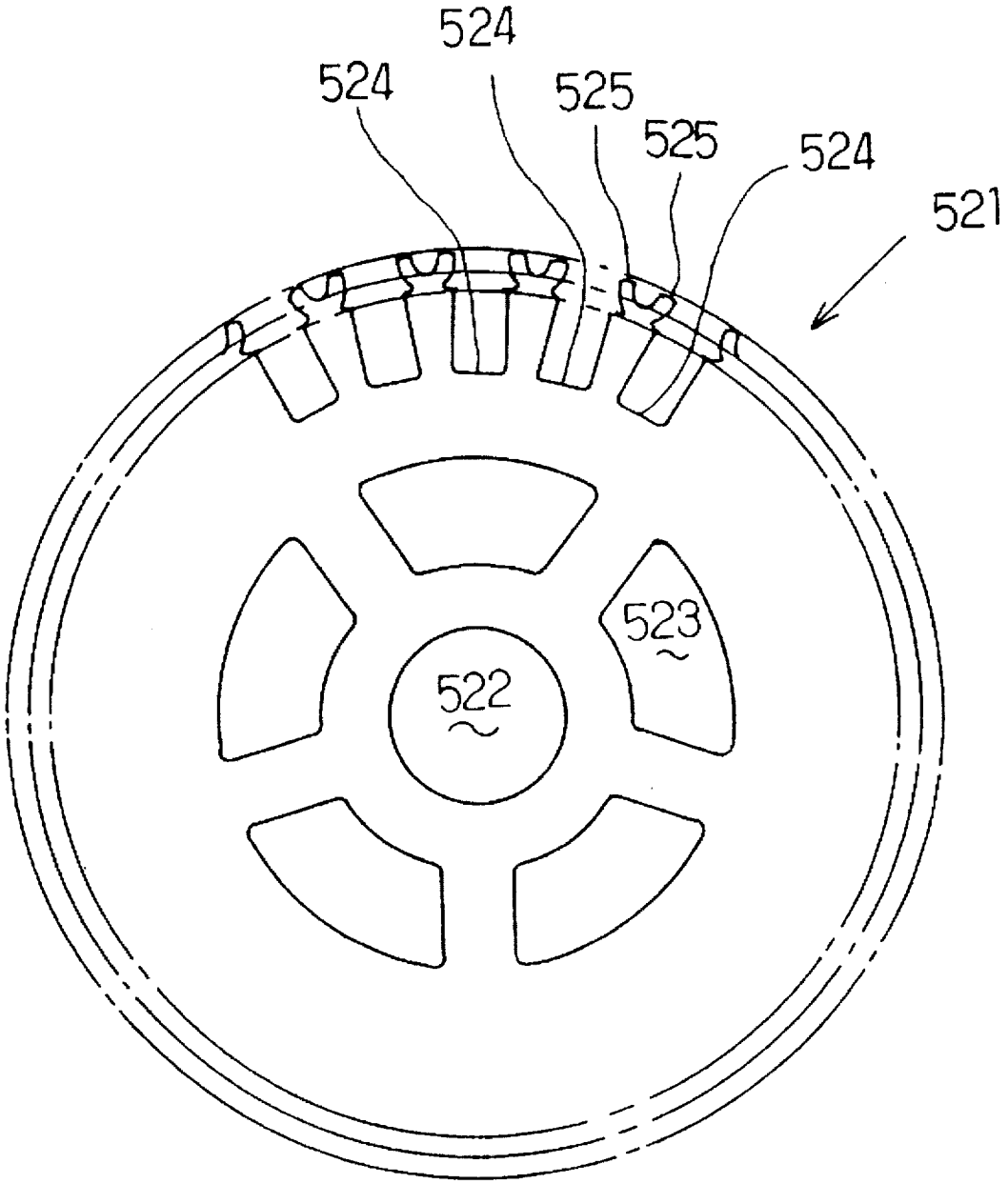
FIG. 4 is a top plan view of a core plate.
Figure 5:
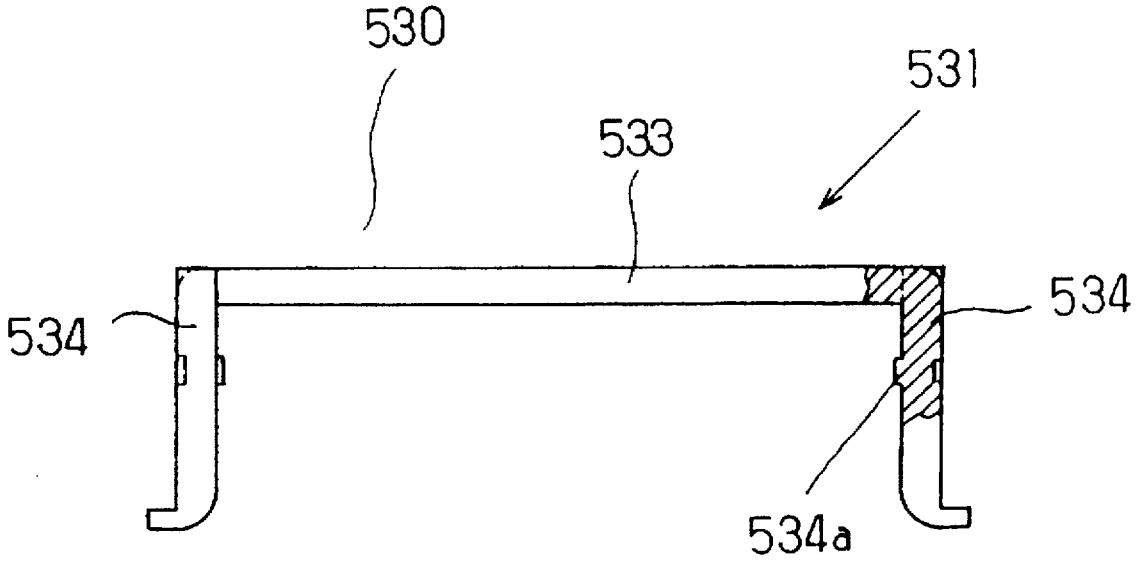
FIG. 5 is a side elevation of an upper coil bar.
Figure 6:
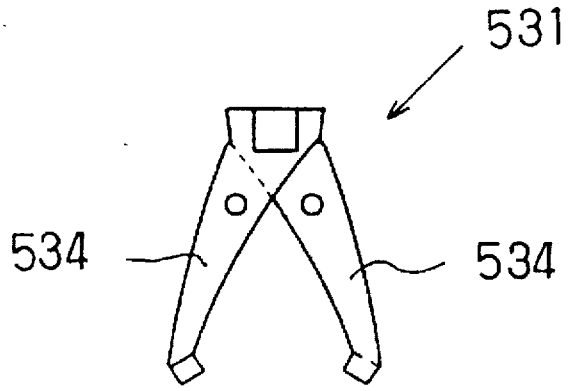
FIG. 6 is a front elevation showing the upper coil bar.

The armature core 520 is prepared by laminating a number of core plates 521, as shown in FIG. 4, and by press-fitting the armature shaft 510 in the hole 522 which is formed in the center of the laminate. The core plate laminate 521 is formed by pressing thin steel sheets and by insulating its surfaces. The core plate laminate 521 is formed in the radially internal side (or around the hole 522) with a plurality of punched holes 523 for lightening the core plate laminate 521 itself. This core plate laminate 521 is formed in its outer circumference with a plurality of (e.g., twenty five) slots 524 for receiving the armature coil 530. Moreover, the outer circumferential end of the core plate laminate 521 is formed between the individual slots 524 with fixing pawls 525 for fixing the armature coil 530 in the slots 524. The fixing pawls 525 will be described in the description of means for fixing the following armature coil 530.

[Armature Coil 530]

The armature coil 530 adopted in the present embodiment is a double-layer toil which is prepared by radially laminating a plurality of (e.g., twenty five) upper-layer coil bars 531 and lower-layer coil bars 532 of the same number as that of the upper-layer coil bars 531. Moreover, these individual upper-layer coil bars 531 and lower-layer coil bars 532 are combined to have their end portions electrically connected to constitute an annular coil.

[Upper-Layer Coil]

The upper-layer coil bar 531 is made of a material having an excellent conductivity (e.g., copper) and is formed with: an upper-layer coil member 533 extending in parallel with the fixed magnetic field devices 550 and held on the outer circumferential side of the slots 524; and two upper-layer coil ends 534 bent inwards from the two ends of the upper-layer coil member 533 and extending perpendicularly to the axial direction of the armature shaft 510. Incidentally, the upper-layer coil member 533 and the two upper-layer coil ends 534 may be formed: integrally by the cold-casting; by the pressing into the C-bent shape; or by the seaming technique of welding the upper-layer coil member 533 and the two upper-layer coil ends 534 made separate.

Figure 7:
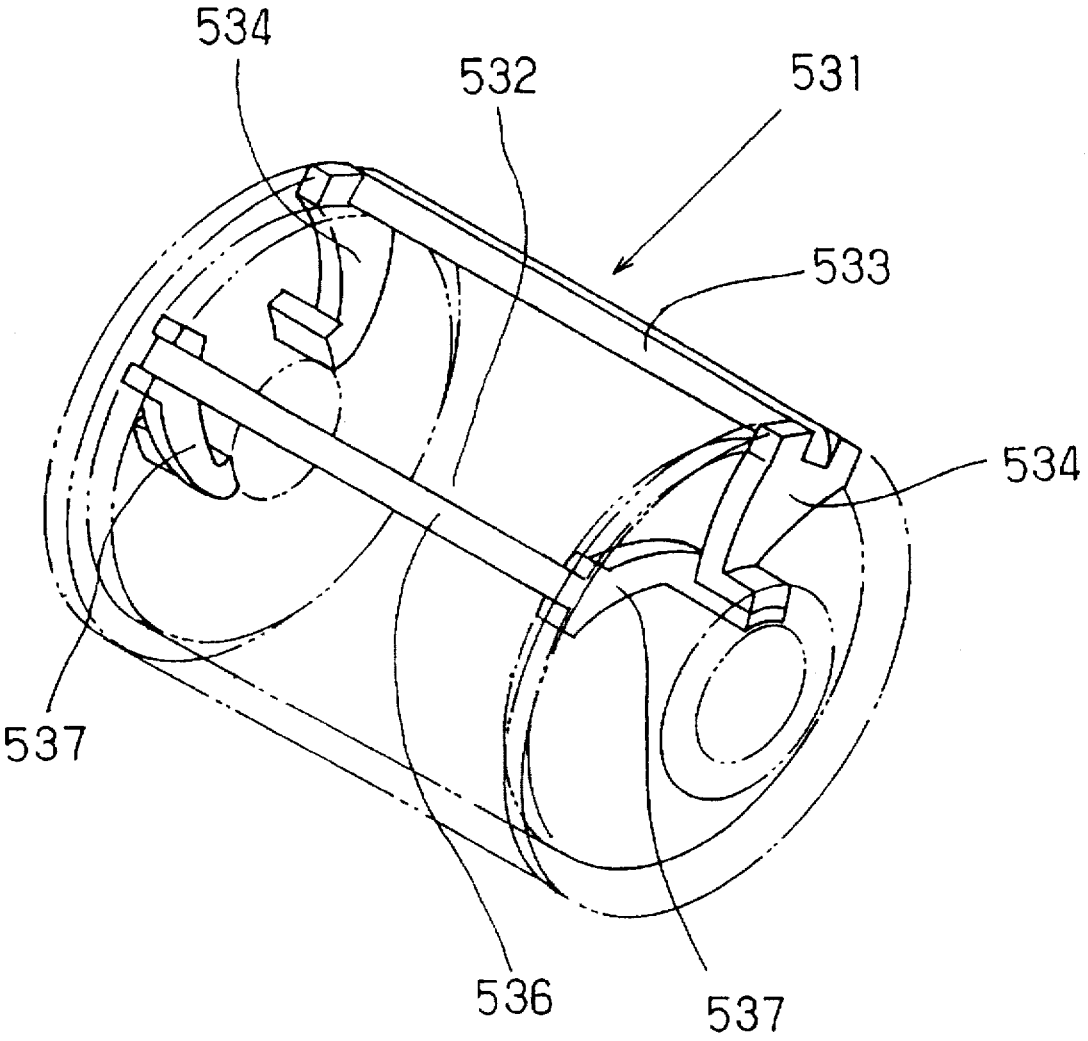
FIG. 7 is a schematic perspective view showing the arranged state of the upper coil bar and a lower coil bar.
Figure 8:
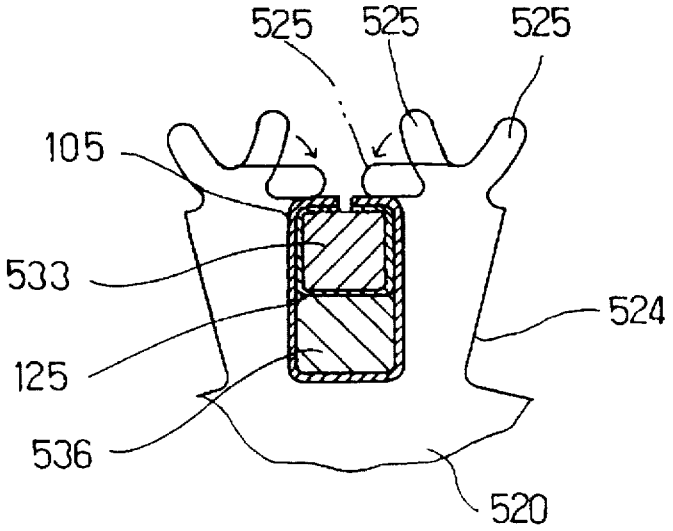
FIG. 8 is a section of an upper coil member and a lower coil member to be fitted in slots.
Figure 9:
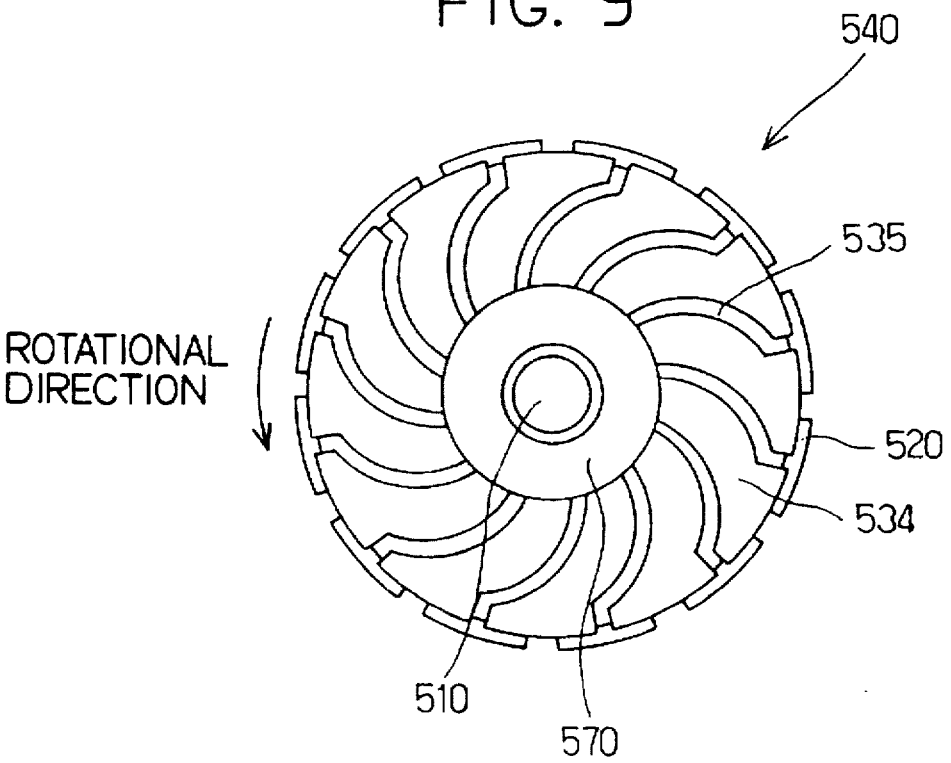
FIG. 9 is a front elevation of an upper coil end assembled with the core of an armature.

The upper-layer coil member 533 is a straight bar having a square section, as shown in FIGS. 5 to 8, and is so forced together with a later-described lower-layer coil member 536 into the slots 524 that it is covered with an upper-layer insulating film (e.g., a thin film of a resin such as nylon or paper), as shown in FIG. 8.

Of the two upper-layer coil ends 534, as shown in FIG. 7, one upper-layer coil end 534 is inclined at the forward side with respect to the rotating direction whereas the other upper-layer coil end 534 is inclined at the backward side with respect to the rotating direction. These two upper-layer coil ends 534 are radially inclined at an equal angle with respect to the upper-layer coil member 533 and are formed into an identical shape. As a result, the upper-layer coil bar 531 takes its identical shape even after it is turned by 180 degrees on the upper-layer coil bar 531. In short, the two upper-layer coil ends 534 are made identical to provide an excellent workability when the upper-layer coil bar 531 is assembled with the armature core 520.

Of the two upper-layer coil ends 534, the upper- layer coil end 534, as located at the side of the magnet switch 600, comes into direct abutment against later-described brushes 910 to feed an armature coil 530 with the electric power. For this, at least the surface of the upper-layer coil ends 534, against which the brushes 910 are to abut, is smoothed. The starter of the present embodiment need not be equipped with any independent commutator for energizing the armature coil 530. In short, the independent commutator can be eliminated to reduce the number of parts and steps of manufacturing the starter thereby to suppress the production cost. Since, moreover, the starter need not be arranged therein with the independent commutator, another effect is that the starter can be axially small-sized.

Furthermore, the upper-layer coil ends 534 come into direct abutment against the brushes 910 so that the heat to be generated by the sliding contact between the upper-layer coil ends 534 and the brushes 910 propagates from the upper-layer coil ends 534 to the upper-layer coil member 533, the armature core 520 and the armature shaft 510. Since, however, the armature coil 530, the armature core 520 and the armature shaft 510 have larger heat capacities than those of the independent commutator of the prior art, the sliding contact portions between the upper-layer coil ends 534 and the brushes 910 can be kept at a low temperature.

[Lower-Layer Coil Bar 532]

The lower-layer coil bar 532 is made, like the upper-layer coil bar 531, of a material having an excellent conductivity (e.g., copper) and is formed with: the lower-layer coil member 536 extending in parallel with the fixed magnetic field devices 550 and held on the inner side of the slots 524; and two lower-layer coil ends 537 bent inwards from the two ends of the lower-layer coil member 536 and extending perpendicularly of the axial direction of the shaft 510. Incidentally, the lower-layer coil member 536 and the two lower-layer coil ends 537 may be formed, as in the upper-layer coil bar 531: integrally by the cold-casting; by the pressing into the C-bent shape; or by the seaming technique of welding the lower-layer coil member 536 and the two lower-layer coil ends 537 made separate.

Incidentally, the insulations between the individual upper-layer coil ends 534 and the individual lower-layer coil ends 537 are retained by the insulating spacer 560, and the insulations between the individual lower-layer coil ends 537 and the armature core 520 are retained by an insulating ring 590 made of a resin (e.g., nylon or phenolic resin).

Figure 3:
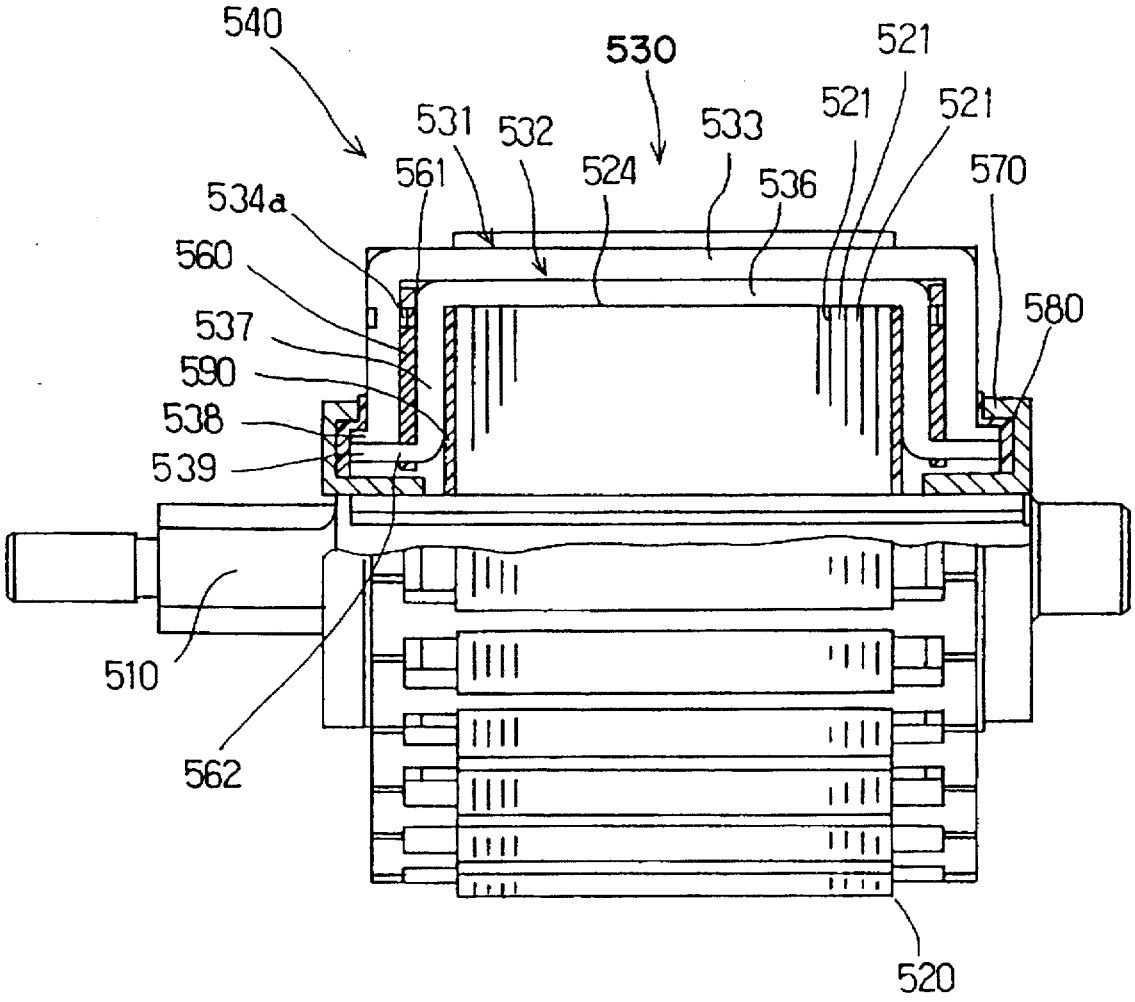
FIG. 3 is a partially sectional side elevation of an armature.

The lower-layer coil member 536 is a straight bar having a square section, as shown in FIGS. 7 and 8, and is forced together with the upper-layer coil member 533 into the slots 524, as shown in FIG. 3. Incidentally, the lower-layer coil member 536 is so fitted in the slots 524 together with the upper-layer coil member 533 covered with the upper-layer insulating film 125, while being covered with a lower-layer insulating film 105 (made of nylon or paper).

Of the two lower-layer coil ends 537, one lower- layer coil end 537, as located at the front side of the starter, is inclined in the direction opposed to that of the upper-layer coil end 534 whereas the other lower-layer coil end 537 at the rear side is also inclined in the direction opposed to that of the upper-layer coil end 534. These two lower-layer coil ends 537 are radially inclined at an equal angle with respect to the lower-layer coil member 537 and are formed into an identical shape. As a result, like the upper-layer coil bar 531, the lower-layer coil bar 532 takes its identical shape even after it is turned by 180 degrees on the lower-layer coil bar 532. In short, the two lower-layer coil ends 537 are made identical to provide an excellent workability when the lower-layer coil bar 532 is assembled with the armature core 520.

The two lower-layer coil ends 537 are formed at their inner circumferential end portions with lower-layer inner extensions 539 extending in the axial direction. The lower-layer inner extensions 539 have their outer circumferences fitted in the recesses 562, which are formed in the inner circumferences of the insulating spacer 560, and overlapped on and electrically and mechanically sealed by the welding to the inner circumferences of upper-layer inner extensions 538 at the end portions of the upper-layer coil ends 534. Incidentally, the lower-layer inner extensions 539 have their inner circumferences insulated and arranged from the armature shaft 510.

On the other hand, the two upper-layer coil ends 534 are formed at their inner circumferential end portions with the upper-layer inner extensions 538 extending in the axial direction. These upper-layer inner extensions 538 have their inner circumferences overlapped on and electrically and mechanically sealed by the welding to the outer circumference of the lower-layer inner extensions 539 which are formed at the inner ends of the later-described lower-layer coil bar 532. Moreover, the upper-layer inner extensions 538 have their outer circumferences abutting through insulating caps 580 on the inner faces of the outer circumferential annular portions 571 of stationary members 570 press-fitted in the armature shaft 510.

[Insulating Spacer 560]

Figure 10:
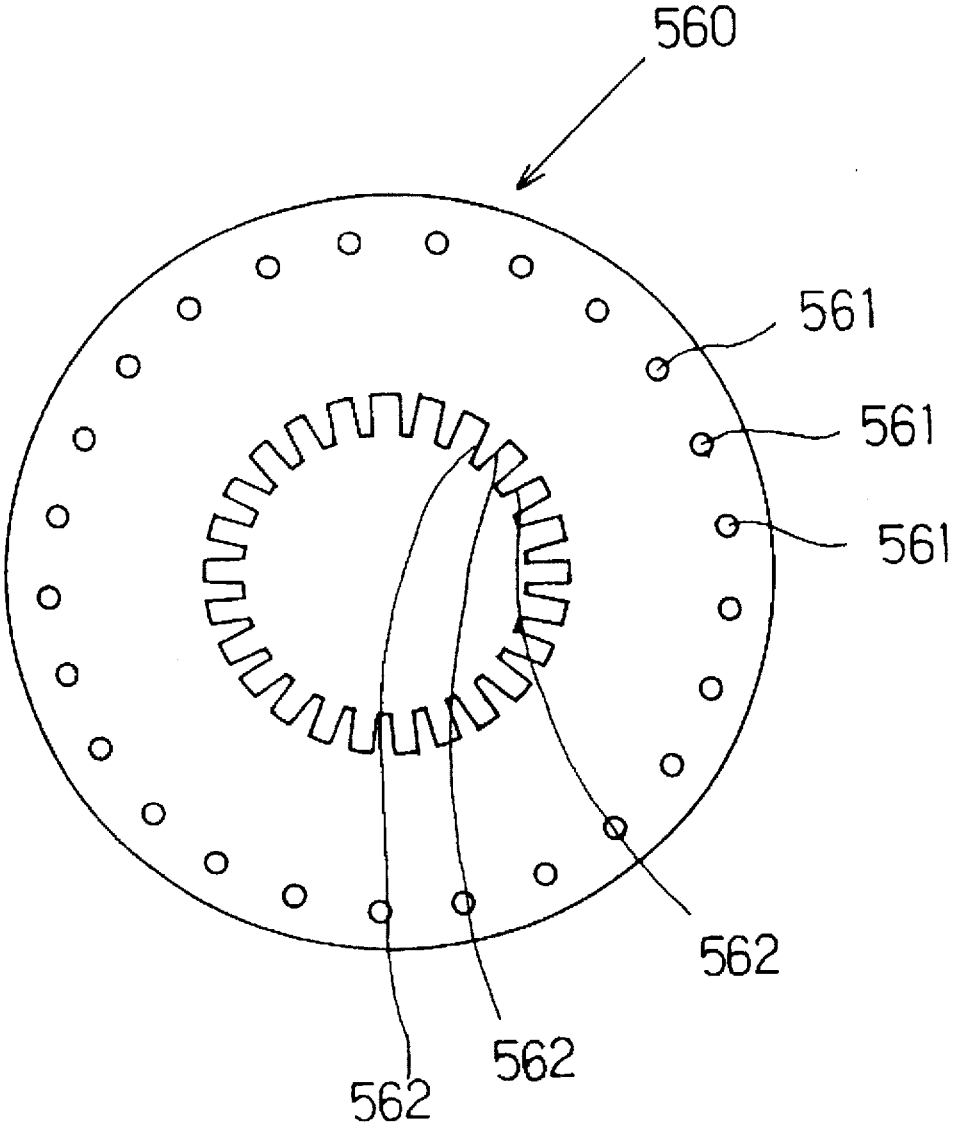
FIG. 10 is a front elevation of an insulating spacer.

The insulating spacer 560 is a thin sheet ring made of a resin (e.g., an epoxy resin, a phenolic resin or nylon) and formed in its outer circumferential side, as shown in FIG. 10, with the plurality of holes 561, in which are fitted the projections 534*a* of the individual upper-layer coil ends 534. On the other hand, the insulating spacer 560 is formed in its inner circumference with recesses 562, in which are fitted the lower-layer inner extensions 539 of the lower-layer coil ends 537. These holes 561 and recesses 562 of the insulating spacer 560 are used to position and fix the armature coil 530, as will be described hereinafter.

[Fixing Member 570]

Figure 11:
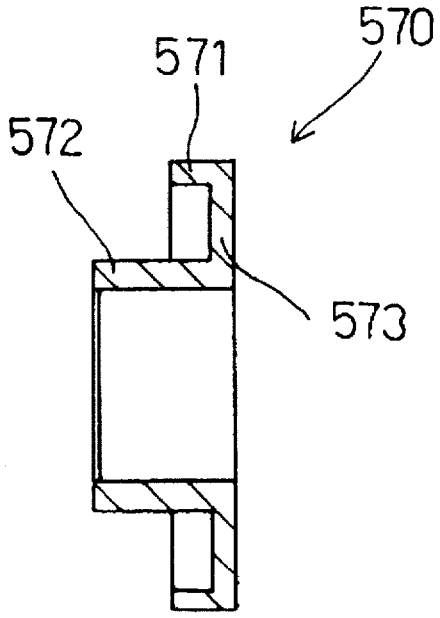
FIG. 11 is a sectional side elevation of a fixing member.
Figure 12:
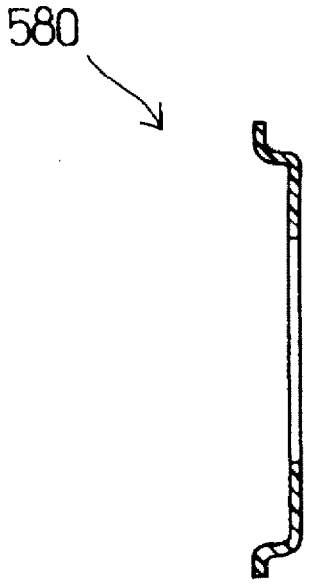
FIG. 12 is a sectional side elevation of an insulating cap.

The fixing member 570 is a resin annular member which is composed, as shown in FIG. 11, of: an inner circumferential annular portion 572 to be press-fitted on the armature shaft 510; a regulating ring 573 extending perpendicularly to the axial direction for blocking the upper-layer coil ends 534 and the lower-layer coil ends 537 from axially extending; and the outer circumferential portion 571 enclosing the upper-layer inner extensions 538 of the upper-layer coil ends 534 for preventing the internal diameter of the armature coil 530 from being extended by the centrifugal force. Incidentally, this fixing member 570 has the disc-shaped insulating cap 580 made of resin (e.g., nylon) and sandwiched between the upper-layer coil ends 534 and the lower-layer coil ends 537, as shown in FIG. 12, so as to ensure the insulations between the upper-layer coil ends 534 and the lower-layer coil ends 537.

In this armature 540, the upper-layer coil ends 534 at the two ends of the upper-layer coil bar 531 and the lower-layer coil ends 537 at the two ends of the lower-layer coil bar 532 forming the armature coil 530 are individually formed perpendicularly to the axial direction of the armature shaft 510. As a result, the armature 540 can have its axial size reduced to shorten the axial size of the motor 500 so that the starter can be made smaller than that of the prior art.

In the present embodiment, moreover, the magnet switch 600 is arranged in the axially shortened space of the motor 500 and the shortened space which is established by eliminating the independent commutator. Although the axial size of the starter is not changed from that of the prior art, the space for the magnet switch 600 mounted above the motor 500 in the prior art can be eliminated to reduce the volume to be occupied by the starter to a far smaller value than that of the prior art.

[Fixed Magnetic Field Device 550]

The fixed magnetic field device 550 is composed of a stator core 558 arranged in the yoke 501 and a stator coil 559 wound on the stator core 558. The stator coil 559 has its one end portion 559*a* arranged in the space at the outer circumference of the planetary gear speed reduction mechanism 300, i.e., at the outer circumference of the center bracket 360. Incidentally, the motor partition 800 is formed with a stepped portion 810 so as to accommodate the aforementioned one end portion. On the other hand, the other end of the stator coil 559 is arranged in the space at the outer circumference of the later-described brush 910.

As a result, the end portion of the stator coil 559 can be arranged in the space around the outer circumferences of the planetary gear speed reduction mechanism and the brushes so that the gap between the armature core 520 of the starter motor and the planetary gear speed reduction mechanism 300 or brush holder 900 can be reduced to reduce the length in the axial direction.

[Magnet Switch 600]

Figure 13:
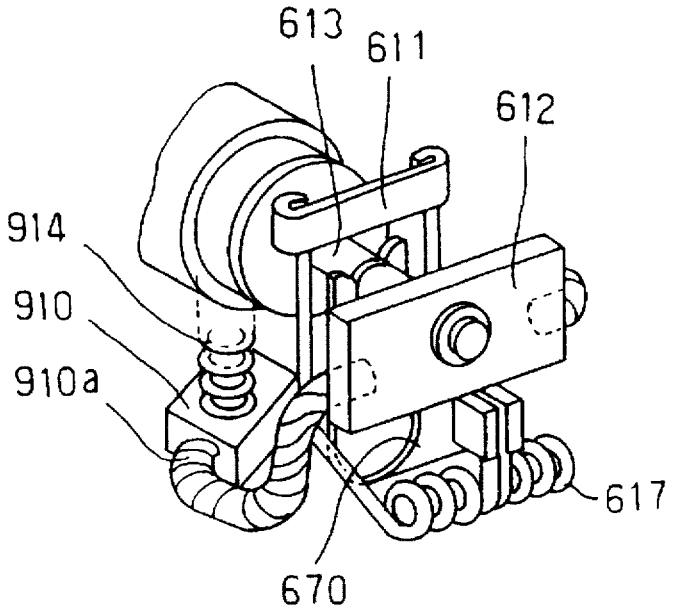
FIG. 13 is a perspective view showing the plunger of the magnet switch.

As shown in FIGS. 1 and 13, the magnet switch 600 is held by the later-described brush holding member 900 and arranged in the later-described end frame 700 such that it is fixed generally perpendicularly to the armature shaft 510.

The magnet switch 600 moves a plunger 610 upwards, when energized, to bring two contacts (i.e., a lower movable contact 611 and an upper movable contact 612) into sequentially contact with the head 621 of a terminal bolt 620 and the abutting portion 631 of a stationary contact 630. Incidentally, the terminal bolt 620 is connected with the not-shown battery cable.

On the upper side of the plunger 610, there is fixed a plunger shaft 615 extending upwards from the plunger 610. The plunger shaft 615 protrudes upward from the through hole which is formed at the center of the stationary core 642. The upper movable contact 612 is carried on the plunger shaft 615 above the stationary core 642 to slide vertically along the plunger shaft 615. This upper movable contact 612 is regulated, as shown in FIG. 31, from moving upwards from the upper end of the plunger shaft 615 by a snap ring 616 attached to the upper end of the plunger shaft 615. As a result, the upper movable contact 612 is made vertically slidable along the plunger shaft 615 between the snap ring 616 and the stationary core 642. Incidentally, the upper movable contact 612 is biased upwards at all times by a contact pressure spring 670 which is made of a leaf spring attached to the plunger shaft 615.

The upper movable contact 612 is made of a metal having an excellent conductivity such as copper and has its two ends brought, when moved upward, into abutment against the two abutting portions 631 of the stationary contact 630. On the upper movable contact 612, moreover, the individual lead wires 910*a* of the paired brushes 910 are fixed electrically and mechanically by the caulking or welding. In the groove of the upper movable contact 612, moreover, there is inserted and fixed electrically and mechanically the end portion of a resistor 617 for providing a plurality of (e.g., two in the present embodiment) restricting means.

Incidentally, the individual lead wires 910*a* of the brushes 910 are fixed electrically and mechanically in the upper movable contact 612 by the caulking or welding. However, the upper movable contact 612 and the individual lead wires 910*a* of the brushes 910 may be integrally formed.

The resistor 617 is constructed of a plurality of turns of metal wire having a high resistance for allowing the-motor 500 to rotate at a low speed at the initial stage of the starter. On the other end of the resistor 617, there is fixed by the caulking or the like the power movable contact 611 which is positioned below the head 621 of the terminal bolt 620.

The lower movable contact 611 is made of a metal having an excellent conductivity such as copper and is brought into abutment against the upper face of the stationary core 642, when the magnet switch 600 is OFF so that the plunger 610 takes its lower position, and into abutment against the head 621 of the terminal bolt 620 before the upper movable contact 612 comes into the abutment against the abutting portion 631 of the stationary contact 630 when the resistor 617 is carried upwards by the plunger shaft 615.

The plunger 610 is formed in its lower face with a recess 682 for receiving a ball member 681 attached to the rear end of the string member 680 (e.g., wire). The recess 682 has its inner circumferential wall internally threaded, as at 683. Into this internal thread 683, there is fastened a fixing screw 684 for fixing the ball member 681 in the recess 682. The string member 680 has its length adjusted by adjusting the insertion of the fixing screw 684 into the internal thread 683. Incidentally, the length of the string member 680 is adjusted such that the regulating pawl 231 of the pinion rotation regulating member 230 is fitted in the teeth 214 of the outer circumference of the pinion gear 210 when the lower movable contact 611 comes into abutment against the terminal bolt 620. Incidentally, the internal thread 683 and the fixing screw 684 constitute an adjusting mechanism.

Since, moreover, the armature shaft 510 is arranged perpendicularly of its axial direction, the magnet switch 600 has its only radial length added to the total axial length of the starter so that it will not enlarge the entire structure of the starter.

[End Frame 700]

Figure 14:
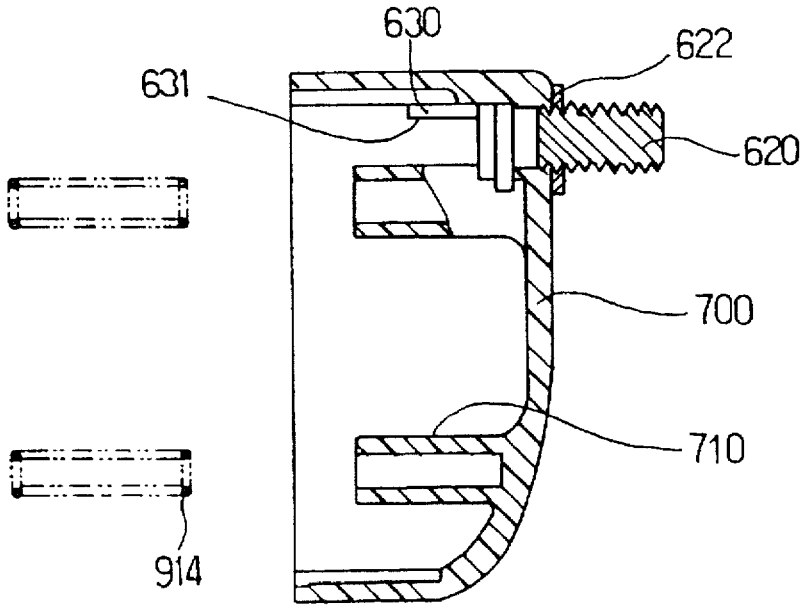
FIG. 14 is a section of an end frame.

The end frame 700 is a magnet switch cover made of a resin (e.g., a phenolic resin) having the magnet switch 600 accommodated therein, as shown in FIG. 14.

The end frame 700 is formed on its back face with spring holding pillars 710 which are protruded forwards according to the positions of the brushes 910 for holding compression coil springs 914 to bias the brushes 910 forwards.

[Brush Holding Member 900]

The brush holding member 900 performs not only the role to partition the inside of the yoke 501 and the inside of the end frame 700 while supporting the rear end of the armature shaft 510 rotatably through the brush holding member bearing 564 but also the roles to act as the brush holder, to hold the magnet switch 600 and to act as a pulley 690 for guiding the string member 680. Incidentally, the brush holder 900 is formed with the not-shown hole for guiding the string member 680 therethrough.

Figure 15:
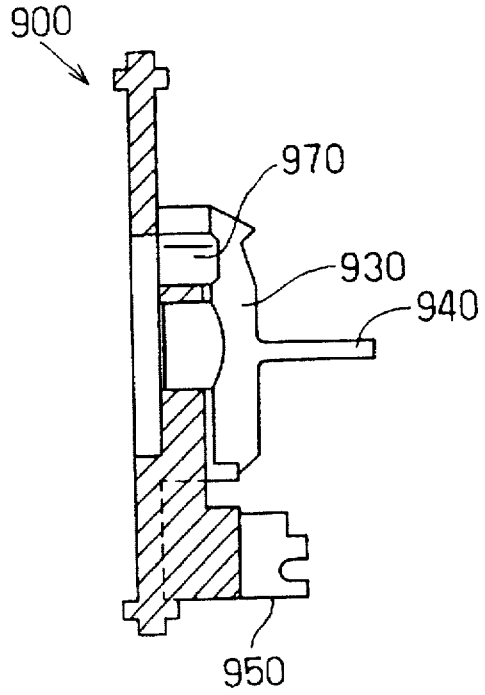
FIG. 15 is a section of a brush holder.
Figure 16:
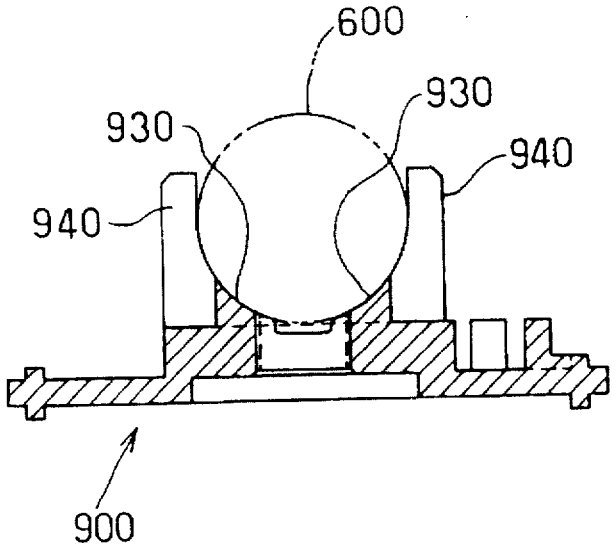
FIG. 16 is a sectional side elevation of the brush holder.

The brush holder 900 is a partition shaped by casting a metal such as aluminum and is formed, as shown in FIGS. 1, 15 and 16, with a plurality of (not shown) brush holding holes 911 and 912 for holding the brushes 910 axially. The upper brush holding holes 911 are the holes for holding the brush 910 to receive the plus voltage and hold the brush 910 through insulating cylinders 913 made of a resin (e.g., nylon or a phenolic resin). On the other hand, the lower brush holding holes 912 are the holes for holding the brush 910 to be grounded to the earth and hold the brush 910 directly therein.

Moreover, the brushes 910 are urged by the compression coils 914 to bring their front end faces onto the rear faces of the upper-layer coil ends 534 at the rear side of the armature coil 530.

Incidentally, the upper brush 910 has its lead wires 910*a* connected electrically and mechanically by the seaming technique such as the welding or caulking to the upper movable contacts 612 to be moved by the magnet switch 600. On the other hand, the lower brush 910 has its lead wires 910*a* connected electrically and mechanically by the caulking to a recess 920 formed in the rear face of the brush holding member 900. Incidentally, the present embodiment is equipped with a pair of lower brushes 910 which are connected to one lead wire 910*a*, which has its center caulked in the recess 920 of the rear face of the brush holding member 900.

The brush holding member 900 is formed on its back face with two pedestals 930 for holding the front face of the magnet switch 600, and two stationary pillars 940 for embracing the magnet switch 600. The two stationary pillars 940 hold the magnet switch 600 by caulking their individual rear ends while the magnet switch 600 abutting against the pedestals 930.

The brush holding member 900 is formed on the lower side of its rear face with a pulley holding portion 950 for holding the pulley 690 for changing the moving direction of the string member 680 from the vertical direction to the axial direction of the magnet switch 600.

[Operations of Embodiment]

Next, the operations of the aforementioned starter will be described with reference to FIG. 17.

When a key switch 10 is set to the start position by the driver, the electric power is fed from a battery 20 to the attraction coil 650 of the magnet switch 600. When the attraction coil 650 is energized, the plunger 610 is attracted by the magnetic force generated by the attraction coil 650 so that it is lifted from its lower position.

Figure 17A:
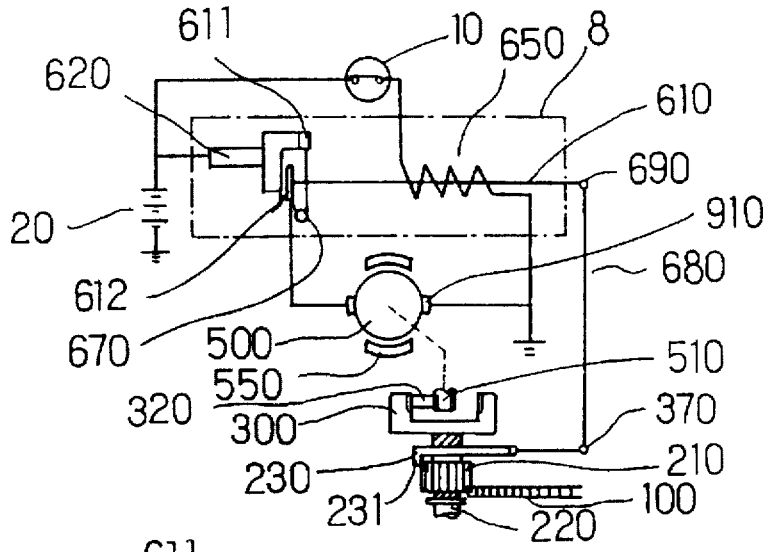
FIGS. 17A, 17B and 17C are electric circuit diagrams showing the working states of the pinion.

As the plunger 610 starts its rise, the upper movable contact 612 and the lower movable contact 611 are lifted by the plunger shaft 615, and the string member 680 also has its rear end lifted. When the rear end of the string member 680 rises, the front end of the same is pulled downwards so that the pinion rotation regulating member 230 is moved downwards. The lower movable contact 611 is brought into abutment against the head 621 of the terminal bolt 620 (as shown in FIG. 17A) by the downward movement of the pinion rotation regulating member 230, when the regulating pawl 231 is fitted in the teeth 214 on the outer circumference of the pinion gear 210. The terminal bolt 620 is supplied with the voltage of the battery 20 so that its voltage is applied to the upper brush 910 in the course of the lower movable contact 611, the resistor 617, the upper movable contact 612 and the lead wire 910*a*. Then, the armature coil 530 generates a relatively weak magnetic force, which acts upon (i.e., attracts or repulses) the magnetic force of the fixed magnetic field device 550 so that the armature 540 is rotated at a low speed.

As the armature shaft 510 rotates, the planetary gear 320 of the planetary gear mechanism 300 is rotationally driven by the sun gear 310 at the front end of the armature shaft 510. In case the rotating torque of the planetary gear 320 to drive the ring gear 100 rotationally through the planet carrier 330 is to be imparted to the internal gear 340, this internal gear 340 has its rotation regulated by the action of the overrunning clutch 350. In short, the internal gear 340 does not rotate, the planet carrier 330 is decelerated by the rotation of the planetary gear 320. When the planet carrier 330 rotates, the pinion gear 210 will rotate but has its rotation regulated by the pinion rotation regulating member 230 so that it moves forwards along the helical spline 221 of the output shaft 220.

As a result of the forward movement of the pinion gear 210, the pinion gear 210 comes into complete meshing engagement with the ring gear 100 of the engine until it comes into abutment against the pinion retaining ring 250. As the pinion gears 210 advances, moreover, the regulating pawl 231 comes out of engagement with the teeth 214 of the pinion gear 210 until its front end drops at the rear side of the washer 215 which is disposed on the rear face of the pinion gear 210.

With the pinion gear 210 being in the forward position, on the other hand, the upper movable contact 612 comes into abutment against the abutting portion 631 of the stationary contact 630. Then, the battery voltage of the terminal bolt 620 is applied directly to the brushes 910 in the course of the upper movable contact 612 and the lead wire 910*a*. In short, the armature coil 530 composed of the individual upper-layer coil bars 531 and the individual lower-layer coil bars 532 is fed with the high current to generate an intense magnetic force thereby to rotate the armature 540 at a high speed.

The rotation of the armature shaft 510 is reduced by the planetary gear mechanism 300 so that the planet carrier 330 is rotationally driven by the increased rotating torque. At this time, the pinion gear 210 has its front end brought into abutment against the pinion retaining ring 250 so that it rotates together with the planet carrier 330. Since, moreover, the pinion gear 210 is in meshing engagement with the ring gear 100 of the engine, it drives the ring gear 100, i.e., the output shaft of the engine rotationally.

Figure 17B:
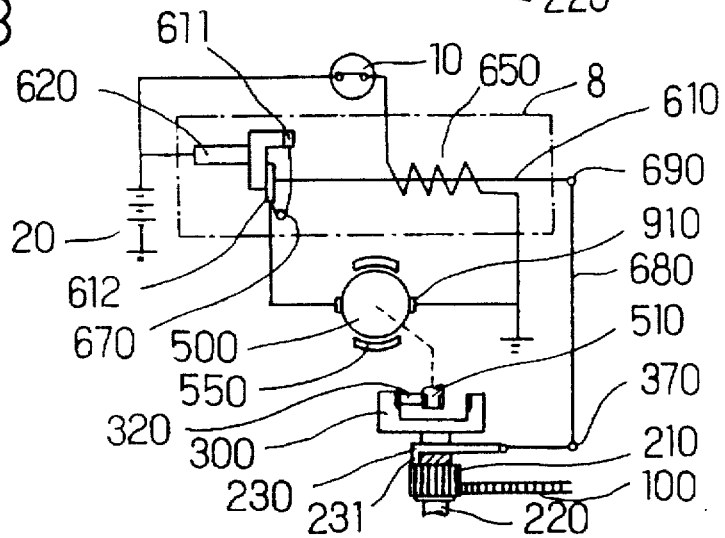

Next, when the engine is started to rotate its ring gear 100 faster than the pinion gear 210, a retracting force is generated in the pinion gear 210 by the action of the helical spline. Since, however, the pinion gear 210 is blocked from its backward movement by the rotation regulating pawl 231 having dropped at the back of the pinion gear 210, the engine can be started without fail while preventing the premature disengagement of the pinion gear 210 (as shown in FIG. 17B).

When the started engine has its ring gear 100 rotated faster than the pinion gear 210, this pinion gear 210 is rotationally driven by the ring gear 100. Then, the rotating torque having been transmitted from the ring gear 100 to the pinion gear 210 is further transmitted through the planet carrier 330 to the pin 332 supporting the planetary gear 320. In other words, the planetary gear 320 is driven by the planet carrier 330. Then, a torque reversed from that for the engine starting time is applied to the internal gear 340 so that the overrunning clutch 350 allows the ring gear 100 to rotate. More specifically, if the torque reversed from that for the engine starting time is applied to the internal gear 340, the roller of the overrunning clutch 350 comes out of the recess of the clutch inner 352 to allow the rotation of the internal gear 340.

In short, the relative rotation of the ring gear 100 of the started engine to drive the pinion gear 210 rotationally is absorbed by the overrunning clutch 350 so that the armature 540 is not rotationally driven by the engine.

After the engine has been started, the key switch 10 is moved out of the start position by the driver to stop the power supply to the attraction coil 650 of the magnet switch 600. When the power supply to the attraction coil 650 is stopped, the plunger 610 is returned back downward by the action of the compression coil spring 660.

Then, the upper movable contact 612 leaves the abutting portion 631 of the stationary contact 630, and the lower movable contact 611 then leaves the heat 621 of the terminal bolt 620 to interrupt the power supply to the upper brush 910.

Figure 17C:
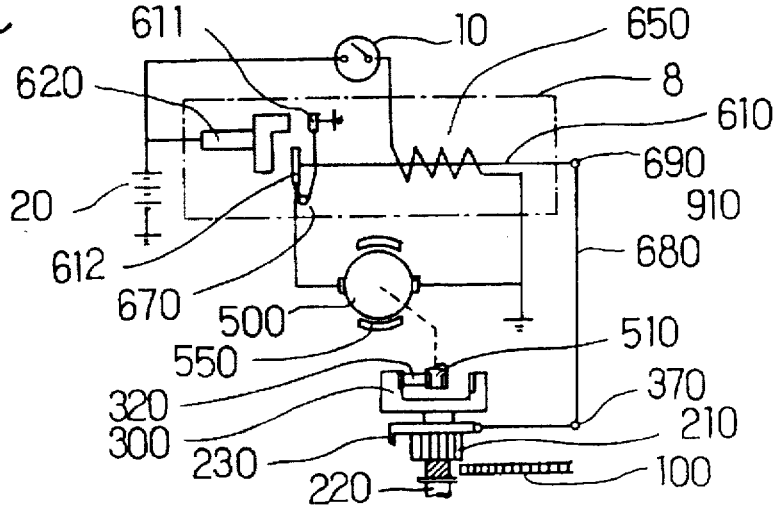

When the plunger 610 is returned downwards, the pinion rotation regulating member 230 is returned upwards by the action of its return spring portion 236 so that the regulating pawl 231 leaves the back of the pinion gear 210. Then, the pinion gear 210 is returned backwards by the action of the return spring 240 to come out of meshing engagement with the ring gear 100 of the engine and to bring its rear end into abutment against the flange-shaped protrusion 222 of the output shaft 220. In short, the pinion gear 210 is returned to the stage before the start of the starter (as shown in FIG. 17C).

As a result that the plunger 610 is returned downwards, moreover, the lower movable contact 611 comes into abutment against the upper face of the stationary core 642 of the magnet switch 600 so that the lead wire 910*a* of the upper brush 910 is turned conductive in the course of the upper movable contact 612, the resistor 617, the lower movable contact 611, the stationary core 642, the magnet switch cover 640 and the brush holding member 900. In short, the upper brush 910 and the lower brush 910 are short-circuited through the brush holding member 900. In this meanwhile, an electromotive force is generated in the armature coil 530 by the inertial rotation of the armature 540. Moreover, this electromotive force is short-circuited through the upper brush 910, the brush holding member 900 and the lower brush 910 so that the braking force is applied to the inertial rotation of the armature 540. As a result, the armature 540 is abruptly stalled.

[Effects of the Embodiment]

The stator coil 559 has its one end portion arranged in the space at the outer circumference of the planetary gear speed reduction mechanism 300, i.e., at the outer circumference of the center bracket 360 and its other end portion arranged in the space at the outer circumference of the brush 910. Therefore, the distance between the armature core 520 of the stator motor and the planetary gear speed reduction mechanism 300 can be decreased to reduce the axial structure.

[Another Embodiment]

Incidentally, in the present invention, the stator coil 559 has its one end arranged at the outer circumference of the planetary gear speed reduction mechanism 300 and its other end arranged in the space at the outer circumference of the brush 910. However, only one end may be arranged at the outer circumference of the planetary gear speed reduction mechanism 300 or in the space at the outer circumference of the brush 910.

Moreover, the fixed magnetic field device 550 is composed of the stator core 558 and the stator coil 559 but may be replaced by a permanent magnet.

In addition, provided that the motor partition wall 800 and the brush holder 900 (which also functions as a motor partition wall) are made of magnetic material, the motor partition wall 800 and the brush holder 900 are arranged to contact the yoke 501 to form a magnetic circuit, and the motor partition wall 800 and the brush holder 900 are arranged closely while keeping the distance to the end face of the stator core 558 sufficiently larger than the distance between the stator core 558 and the armature core 520, the leakage flux caused at the end portion of the stator core 558 flows through the motor partition wall 800 and the brush holder 900 and does not flow around the armature coil end portion. Thus, the coil inductance during the commutating operation decreases and reduces undesired influence on the commutation.

INDUSTRIAL APPLICABILITY

As has been described hereinbefore, the starter according to the present invention can be used as a starter for a gear speed reduction mechanism, which can have its axial length suppressed and its mountability and impact-resistance.

We claim:

1. A starter with a planetary gear speed reduction mechanism, comprising:

a starter motor including an armature shaft for rotatably holding an armature core wound with an armature coil, a commutator connected with said armature coil and arranged generally in parallel with an end portion of said armature core, a brush slidably held on said commutator, and a fixed magnetic field device arranged on an outer circumference of said armature core; and a planetary gear speed reduction mechanism including a sun gear formed on an outer circumference of said armature shaft of said starter motor, a planetary gear supported at one end of a drive shaft arranged coaxially with said armature shaft and meshing with said sun gear, and an internal gear meshing with said planetary gear, wherein said fixed magnetic field device of said starter motor has its end portion overlapping at least one of said planetary gear speed reduction mechanism and said brush.

2. A starter with a planetary gear speed reduction mechanism according to claim 1, wherein:

said armature coil includes an upper-layer and lower-layer armature coils arranged in a slot of said armature core;

each of said upper-layer and lower-layer armature coils has a coil bar arranged in said slot, and a coil end arranged at one end of said coil bar in generally parallel with an end face of said armature core;

said coil end of said upper-layer coil bar is electrically connected to said coil end of said lower-layer coil bar spaced away by a predetermined pitch; and said coil end of said upper-layer coil bar is used as said commutator.

3. A starter with a planetary gear speed reduction mechanism according to claim 1, wherein:

said armature coil includes an upper-layer and lower-layer armature coils arranged in a slot of said armature core;

each of said upper-layer and lower-layer armature coils has a coil bar arranged in said slot, and a pair of coil ends arranged at both ends of said coil bar in generally parallel with end faces of said armature core;

said coil ends of said upper-layer coil bar are electrically connected to corresponding coil ends of said lower-layer coil bar spaced away by a predetermined pitch; and one of said coil ends of said upper-layer coil bar is used as said commutator.

4. A starter with a planetary gear speed reduction mechanism according to any one of claims 1 through 3, further comprising:

a magnet switch for supplying an electric power to said starter motor, said magnet switch being arranged at a brush side of said starter motor and generally perpendicularly to an axial direction of said armature shaft.

5. A starter with a planetary gear speed reduction mechanism, comprising:

a starter motor including an armature shaft for rotatably holding an armature core wound with an armature coil, a commutator connected with said armature coil and arranged generally in parallel with an end portion of said armature core, a brush slidably held on said commutator, a cylindrical yoke arranged around an outer circumference of said armature core to form a magnetic circuit, and a fixed magnetic field device arranged on an inner circumference of said yoke;

a planetary gear speed reduction mechanism including a sun gear formed on an outer circumference of said armature shaft of said starter motor, a planetary gear supported at one end of a drive shaft arranged coaxially with said armature shaft and meshing with said sun gear, and an internal gear meshing with said planetary gear; and a motor partition wall made of a magnetic material, contacting said yoke and arranged adjacent to an end face of said fixed magnetic field device to form said magnetic circuit, wherein said fixed magnetic field device of said starter motor has its end portion overlapping at least one of said planetary gear speed reduction mechanism and said brush.

6. A starter with a planetary gear speed reduction mechanism according to claim 5, wherein:

said motor partition wall is formed by at least one of a motor partition wall which separates said planetary gear speed reduction mechanism and said starter motor and a brush holder which holds said brush.

* * * * *